US006170135B1

(12) United States Patent
Pferdehirt

(10) Patent No.: US 6,170,135 B1
(45) Date of Patent: Jan. 9, 2001

(54) WATERTIGHT PRESS FASTENER PART

(75) Inventor: Thomas Pferdehirt, Wuppertal (DE)

(73) Assignee: YKK Europe Ltd., London (GB)

( * ) Notice: Under 35 U.S.C. 154(b), the term of this patent shall be extended for 0 days.

(21) Appl. No.: 09/293,405

(22) Filed: Apr. 16, 1999

(51) Int. Cl.[7] ..... A44B 17/00
(52) U.S. Cl. ..... 24/691; 24/687
(58) Field of Search ..... 24/90.1, 90.5, 24/682.1, 104, 106, 107, 108, 687, 691

(56) References Cited

U.S. PATENT DOCUMENTS 5,003,673 * 4/1991 Nysten .
5,115,548 * 5/1992 Nysten .
5,214,811 * 6/1993 Priem .

FOREIGN PATENT DOCUMENTS 3742007 6/1988 (DE) .
4016077 12/1990 (DE) .
9014692 2/1991 (DE) .
9216068 2/1993 (DE) .
4411465 3/1995 (DE) .
197 46 908 A1 5/1999 (DE) .
0401574 12/1990 (EP) .

* cited by examiner

*Primary Examiner*—James R. Brittain
(74) *Attorney, Agent, or Firm*—Friedrich Kueffner

(57) ABSTRACT

A watertight press fastener part formed of an eyelet part (1 or 3) including an eyelet body (2 or 4) or of a ball part (5) including a ball body (6) and a cap rivet (7) which is fixable to a flat material (9), preferably in the form of a climate membrane, in a watertight manner by riveting. An elastically deformable sealing element (11 or 13) which is constructed as a molded part contacts the flat material (9). This sealing element is penetrated by the rivet shank (8) of the cap rivet (7) and has, in the assembled state, due to the deformation of the rivet shank, a press face which is formed in an analogous manner by deformation and which surrounds the axial opening (10) of the press fastener part. Together with a counter-face at the eyelet part or at the ball part, the press face defines the clamping area for the flat material (9).

9 Claims, 5 Drawing Sheets

Fig.1
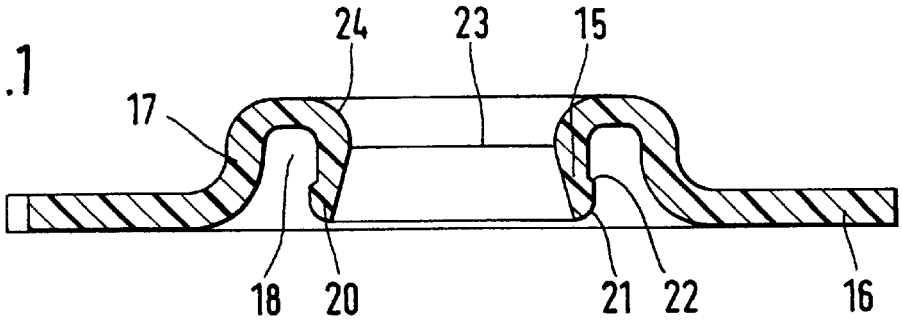
Fig.2
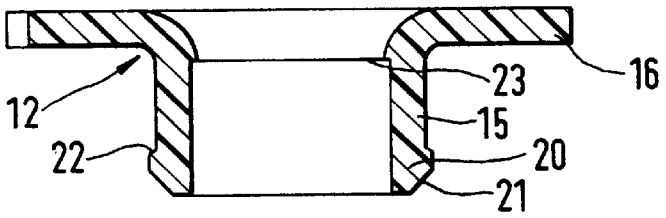
Fig.3
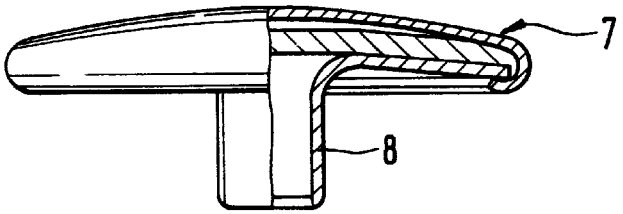
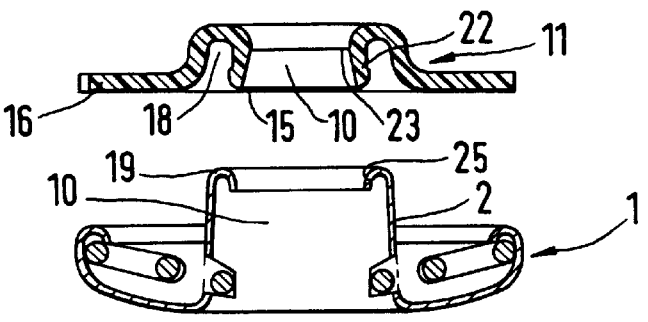
Fig.4

Fig.8
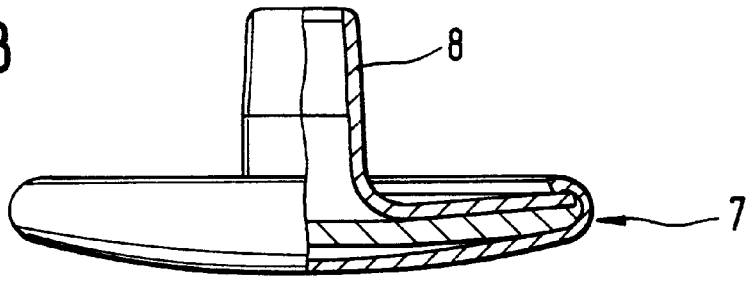
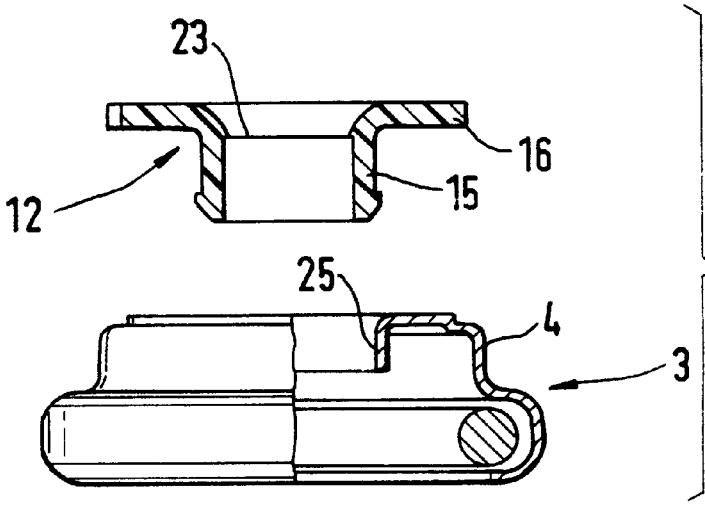
Fig.9
Fig.10
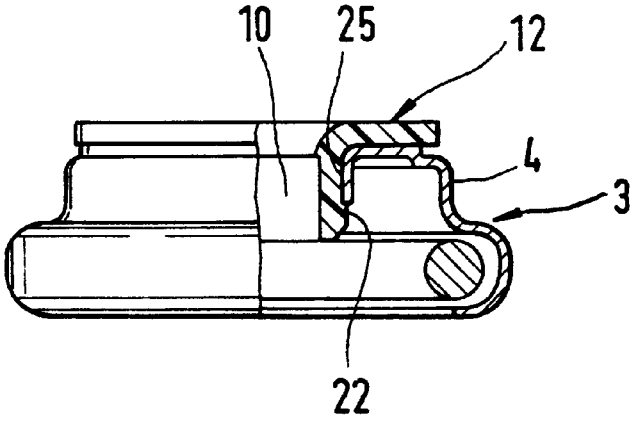

Fig.11
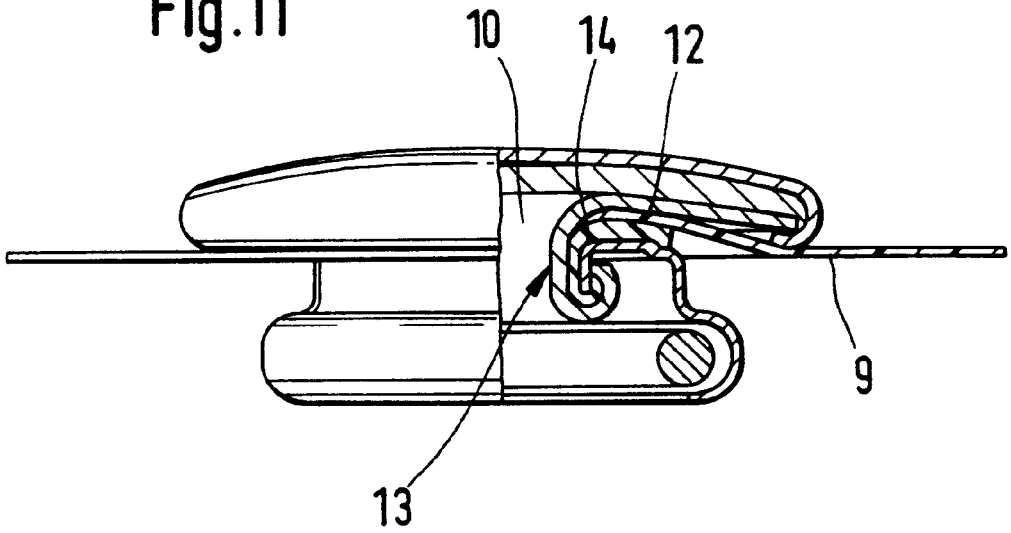
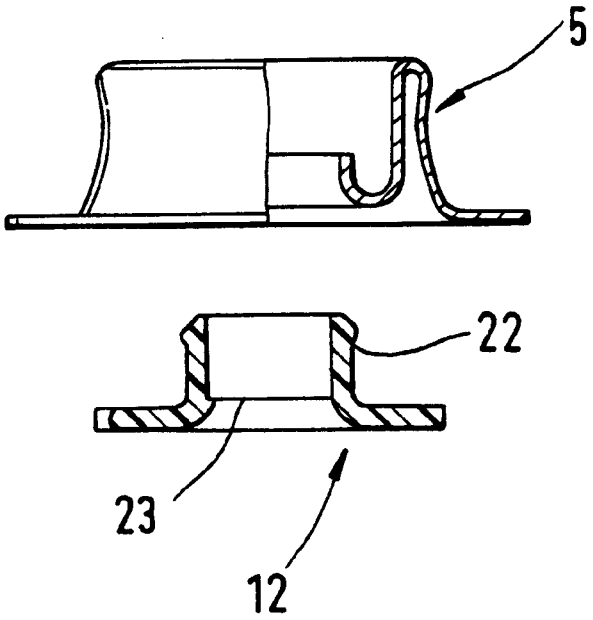
Fig.12

WATERTIGHT PRESS FASTENER PART

BACKGROUND OF THE INVENTION

1. Field of the Invention

The invention is directed to a watertight snap fastener part or press fastener part formed of an eyelet part comprising an eyelet body or of a ball part comprising a ball body, each of which has an axial opening, and a cap rivet which is fixable to a flat material, preferably in the form of a breathable or weatherproof or climate membrane,, in a watertight manner by riveting, with an elastically deformable sealing element which makes contact at the flat material and is constructed as a molded part, wherein the sealing element, being penetrated by the rivet shank of the cap rivet, has in the assembled state due to the deformation of the rivet shank a press face which is formed in an analogous manner by deformation and which surrounds the axial opening of the press fastener part and, together with a counter-face at the eyelet part or at the ball part, defines the clamping area for the flat material.

2. Description of the Related Art

In a known press fastener part of this type (DE 44 11 465 C1), the sealing element which is formed by an intricately shaped plastic disk and, at the underside of the cap rivet, forms a stationary component part of the latter has a central bore hole which is penetrated by the rivet shank, but which comprises a caplike cover, wherein the rivet shank reaches up to the latter.

When riveting with the eyelet part formed in the shape of a bar spring die, the eyelet part, after penetrating the flat material, engages in a front-side annular groove of the sealing element by a socket-like rivet shank receptacle which terminates in an annular edge that is rounded on the radial inside and forms the opening of the eyelet part, wherein the annular groove of the sealing element is coaxial to the rivet shank and adjoins the caplike cover. This annular groove is surrounded concentrically by an annular projection formed integral therewith as a front-side press face. When assembled, the rivet shank penetrates the edge of the caplike cover as well as the flat material, and the annular projection, in cooperation with the oppositely located surfaces of the eyelet part and of the sealing element, pretensions the flat material and fixes it.

In practice, it has been shown that flat material formed by a climate membrane of normal strength is adequately fixed in this press fastener part and also withstands very high tear-out forces. However, difficulties result when climate membranes of greater dimensions are used, e.g., three-ply laminates or laminates comprising a stronger woven fabric, for example, comprising loden wool.

A known construction of a watertight ring loop for footwear (DE-GM 92 16 068) in which the rivet shank end which tapers to a point is constructed in a closed manner makes use of a sealing element having a sleeve-shaped portion and an annular disk-shaped portion which extends radially outward following the sleeve-shaped portion. When the rivet shank which penetrates the sleeve-shaped portion and the footwear receiving the shoe clasps or shoe fittings is pressed with a rivet head plate, there occurs only a local pressing of the sealing element, but no substantial deformation which increases the hold, so that this known rivet pressing is also not usable for fixing a press fastener part to thicker climate membranes.

Further, a construction of an upper and lower press fastener part is known (DE 37 42 007 C) which comprises a watertight rivet cap whose shank penetrates through a flat material during pressing and is driven into a plastic part constructed in the form of a spherical part or eyelet part so as to be fixed to this flat material. This fixation method is also not suitable for fixing press fastener parts to thicker flat material.

Finally, it is also known (DE-GM 90 14 692) to assign a sealing element to a cap rivet for press fastener parts in the area between the rivet shank and underside of the rivet cap, which sealing element undergoes a deformation of varying intensity in the manner of an upset when pressed with a ball part or with an eyelet part with the flat material therebetween. The holding strength of the thicker flat material in the press fastener part is also less than desirable in this case, as would be expected.

Further, a press fastener connection is known (EP 0 401 574 A) in which the press fastener part formed by a ball part is fixed to the flat material by a cap rivet with a rivet shank which tapers to a point and is constructed in a closed manner, which rivet shank initially penetrates a sealing ring of elastic material before it penetrates the flat material and engages in the interior of a molded sheet-metal body forming the ball part and having a hat-shaped elastic plastic inserted in this molded sheet-metal body. When the rivet shank is pressed, a widening of the tip area of the rivet shank takes place and the flat material is tensioned in the area between the edge of the hat-shaped elastic plastic and the sealing ring, especially in the area of the outer zone of the hat-shaped molded sheet-metal body and that of the edge of the cap rivet. The flat material undergoes a similar clamping in the construction in which the press fastener part is formed by an eyelet part. In both cases, the holding force by which the flat material is grasped is not sufficient to fix thicker material so securely that there is no risk of tearing out.

SUMMARY OF THE INVENTION

It is the object of the invention to further develop the press fastener part of the type mentioned in the beginning while simultaneously simplifying the construction such that a fixed hold is ensured in this flat material even with a load of up to 300 N, also with thicker climate membranes.

In the press fastener part according to the invention in which this object is met, the sealing element comprises a sleeve-like portion followed by a radially outwardly extending annular disk-shaped portion, in that the sleeve-like portion of the sealing element is provided in the region of its free edge with a radially outwardly directed reinforcement forming a circumferentially extending undercut and the latter is provided with a circumferentially extending bevel facilitating assembly, proceeding from the end face of the free edge and facing the annular disk-shaped portion, and in that this sealing element, for purposes of preassembly, can be mounted on the eyelet body forming the eyelet part or on the ball body forming the ball part in such a way that it penetrates the axial opening of the eyelet body or the axial opening of the ball body, respectively, with its sleeve-shaped portion and, when subsequently riveted with the rivet shank of the cap rivet guided through the sleeve-shaped portion, contacts by its annular disk-shaped portion the flat material interposed between the eyelet part or ball part and cap rivet and can be pressed with this flat material.

As a result of this construction, the sealing element has, from the outset, to the fullest extent the end shape in the sealing area after placement. Also, when mounted on thicker climate membranes, a fixed hold is ensured even in the event of extensive stresses or loading.

In a further development, a feature that has proven especially favorable consists in that the sealing element is provided in the sleeve-shaped area receiving the rivet shank with a circumferentially extending edge formed by a reduction in diameter, wherein a rounded mouth facilitating the insertion of the rivet shank and flat material leads to this circumferentially extending edge. This edge prevents the flat material, once it has been drawn in, from being pulled back again and assists the dependability of the aimed for water tightness.

A construction that has proven especially effective with respect to securing a fixed hold of the flat material in the area of the rivet shank bore hole consists in that the free end of the sleeve-shaped portion of the sealing element is deformed into a position in which it is bent by almost 180° outward and backward while being carried along by the outer end of the rivet shank during pressing accompanied by fixation of the flat material pierced through by the rivet shank.

Not least, with respect to increased protection against the shearing off of the reinforcement with undercutting, the circumferentially extending bevel proceeding from the end face of the free edge of the sleeve-shaped portion of the sealing element and facing the annular disk-shaped portion is constructed so as to be rounded on the outside.

In a first implemented construction of the press fastener part, it is especially advantageous when the sleeve-shaped portion of the sealing element is connected with the annular disk-shaped portion by means of a connecting portion which, together with the sleeve-shaped portion, defines a circumferentially extending free groove serving to receive the end of the eyelet shank.

A particularly durable fixation of the press fastener part formed by an eyelet part with respect to the flat material results when a radially extending transition area follows the holding area of the eyelet part, which holding area extends coaxial to the sleeve-shaped portion of the sealing element, wherein, after the pressing of the eyelet part with the rivet shank, the transition area supports the annular disk-shaped portion of the sealing element and holds it in position pressing against the underside of the rivet cap accompanied by fixed clamping of the flat material.

This applies in an analogous manner for a press fastener part formed by a ball part when a coaxially undulant ball part area which is insertable into the eyelet part and cooperates therewith follows the holding area of the ball part, which holding area extends coaxial to the sleeve-shaped portion of the sealing element, wherein, after the pressing of the ball part with the rivet shank, the ball part area holds the annular disk-shaped portion of the sealing element in position pressing against the underside of the rivet cap accompanied by deformation and with fixed clamping of the flat material.

Further details, advantages and features of the invention are given in the following description with reference to the accompanying drawing.

BRIEF DESCRIPTION OF THE DRAWING

FIGS. 1 and 2 show axial sections in enlarged scale through two embodiment forms of the sealing element according to the invention for a watertight press fastener part;

FIG. 3 shows an axial section through a cap rivet;

FIG. 4 shows an axial section through the sealing element and a rod spring eyelet prior to the mounting of the sealing element on the end of the eyelet shank;

FIGS. 7 and 8 respectively, show an axial section through a cap rivet;

FIG. 9 shows an axial section through the sealing element according to FIG. 2 and an annular spring eyelet prior to mounting the sealing element on this eyelet part;

FIG. 10 shows an axial section through the sealing element-eyelet part unit in the assembled state;

FIG. 11 shows an axial section through the press fastener part formed from the cap rivet according to FIG. 7 and from the unit according to FIG. 10 after being fixed to a climate membrane;

FIG. 12 shows an axial section through the sealing element according to FIG. 2 and of a ball part prior to the mounting of the sealing element on this ball part;

DESCRIPTION OF THE PREFERRED EMBODIMENTS

Figure 5:
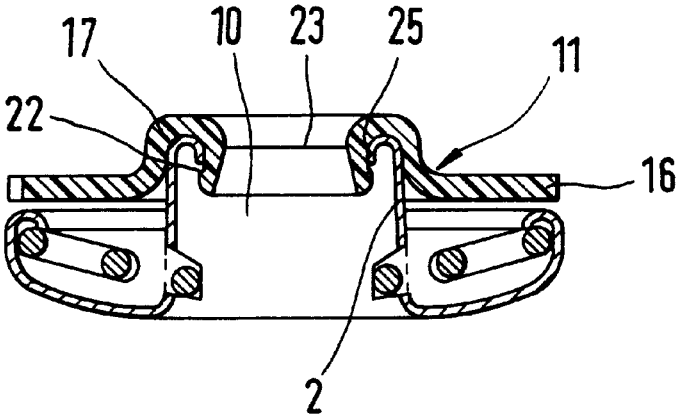
FIG. 5 shows an axial section through the sealing element rod spring eyelet unit in assembled state.

The press fastener part is formed, on the one hand, of an eyelet part 1 comprising an eyelet body 2 or of an eyelet part 3 comprising an eyelet body 4 or of a ball 5 with a ball body 6 and, on the other hand, of a cap rivet 7 which can be fixed in a watertight manner to a flat material 9, preferably in the form of a climate membrane, with the eyelet part or the ball part by riveting by means of its rivet shank 8. In so doing, the rivet shank 8 penetrates an axial opening 10 of the eyelet part 1 or 3 or of the ball part 5. A sealing element 11 or 12 is associated with the eyelet part or ball part. This sealing element 11 or 12 contacts the flat material, is elastically deformable and is constructed as a molded article. When penetrated by the rivet shank 8 of the cap rivet 7 in the assembled state because of the rivet shank deformation it has a press face 13 which is formed in an analogous manner by deformation and which surrounds the opening 10 of the press fastener part. This press face 13, together with a counter-face 14 at the eyelet part 1, 3 or at the ball part 5, defines the clamping area for the flat material 9.

As can be seen from the drawing, especially from FIGS. 1 and 2, the sealing element 11, 12 has a sleeve-shaped portion 15 followed by a radially extending, annular disk-shaped portion 16.

In the first construction according to FIG. 1, the sleeve-shaped portion 15 of the sealing element 11 is connected with the annular disk-shaped portion 16 by means of a connecting portion 17 which defines a circumferentially extending free groove 18 with the sleeve-shaped portion 15. It is the function of this groove 18 when the sealing element 11 is mounted with the eyelet part 1 to receive the end 19 of the eyelet body 2, which end 19 is bent inward and backward in a semicircular manner.

As can be seen especially from FIGS. 1 and 2 which are in enlarged scale, the sleeve-shaped portion 15 of the sealing element 11 comprises at its free edge 20 a circumferentially extending bevel 21 facing the annular disk-shaped portion 16. In the embodiment example of the sealing element 11 according to FIG. 1, this bevel 21 is constructed so as to be rounded on the outside.

In the region of the free edge 20, the sleeve-shaped portion 15 of both constructions of the sealing element 11, 12 according to FIGS. 1 and 2 is provided in each instance with a reinforcement which faces radially outward and forms a circumferentially extending undercut 22, wherein the bevel 21 extends toward the reinforcement.

It is clear from FIG. 1 that the sealing element 11 is provided in the sleeve-shaped portion 15 receiving the rivet shank 8 with a circumferentially extending edge 23 formed by a diameter reduction, wherein a rounded mouth 24 which facilitates the insertion of the rivet shank and flat material during pressing leads to this circumferentially extending edge 23.

Figure 6:
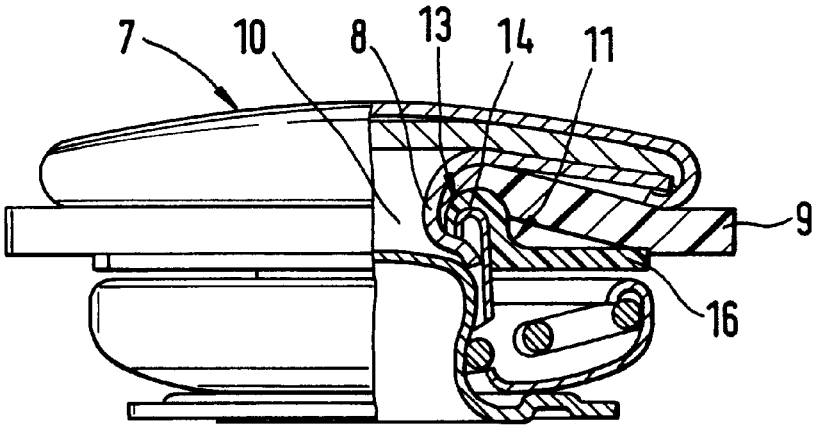
FIG. 6 shows an axial section through the press fastener part formed by the cap rivet according to FIG. 3 and by the unit according to FIG. 5 after fixing to a climate membrane.
Figure 7:
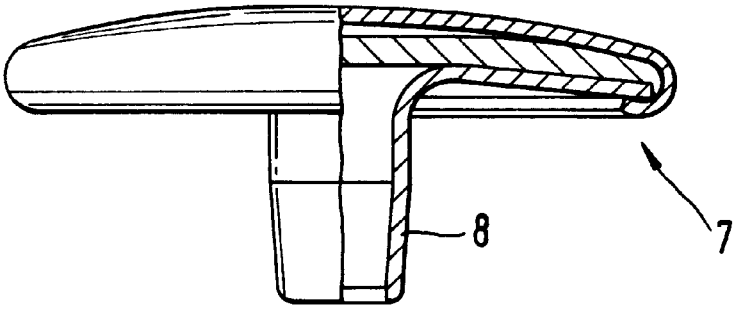

It can further be seen from the drawing that the end of the sleeve-shaped portion 15 which is provided with a reinforcement in the area of the free edge 20 is deformed into a position in which it is bent by almost 180° outward and backward while being carried along by the outer end of the rivet shank 8 during pressing accompanied by fixing of the flat material 9 through which the rivet shank 8 penetrates. This applies not only to the sealing element 12, whose shape after pressing is clearly discernible from FIGS. 11 and 14, but also to the sealing element 11 as follows from FIG. 6. In every case, during pressing, the hole rim of the flat material 9 is carried along far into the area between the deformed sealing element and the directly contacting rivet shaft, resulting in a particularly high holding force and tear-out strength.

With respect to construction, it is characteristic for the construction according to FIGS. 2, 9, 10, 12 and 13 that the annular disk-shaped portion 16 directly adjoins the sleeve-shaped portion 15 of the sealing element 12 so as to extend roughly at right angles relative to it. The eyelet part or ball part 1, 3 or 5 terminates in a holding portion 25 which engages behind the undercut 22 of the sleeve-shaped portion at the outer side of the sleeve-shaped portion 15.

In the construction according to FIGS. 10 and 11, a radially extending transition area 26 adjoins the holding portion 25 of the eyelet part, which holding portion 25 extends coaxial to the sleeve-shaped portion 15 of the sealing element 12. After the pressing of the eyelet part with the rivet shank 8, this transition area 26 supports the annular disk-shaped portion of the sealing element and holds it so as to be pressed against the underside of the rivet cap while fixedly clamping the flat material 9.

Figure 13:
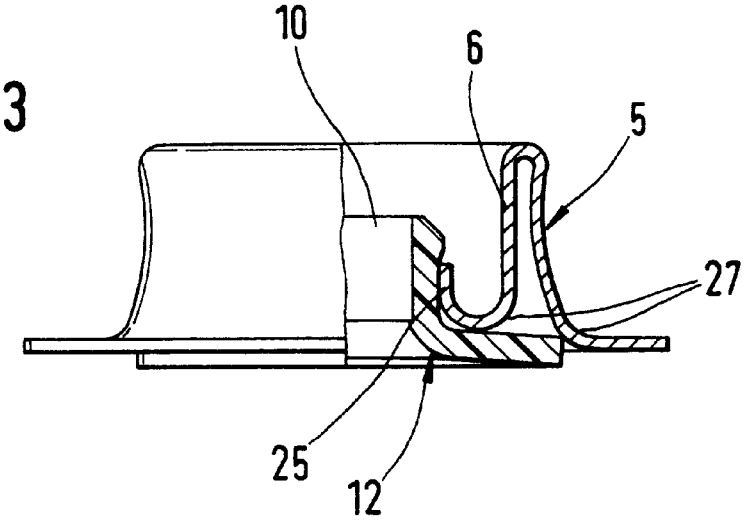
FIG. 13 shows an axial section through the sealing element-ball part unit in the assembled state.
Figure 14:
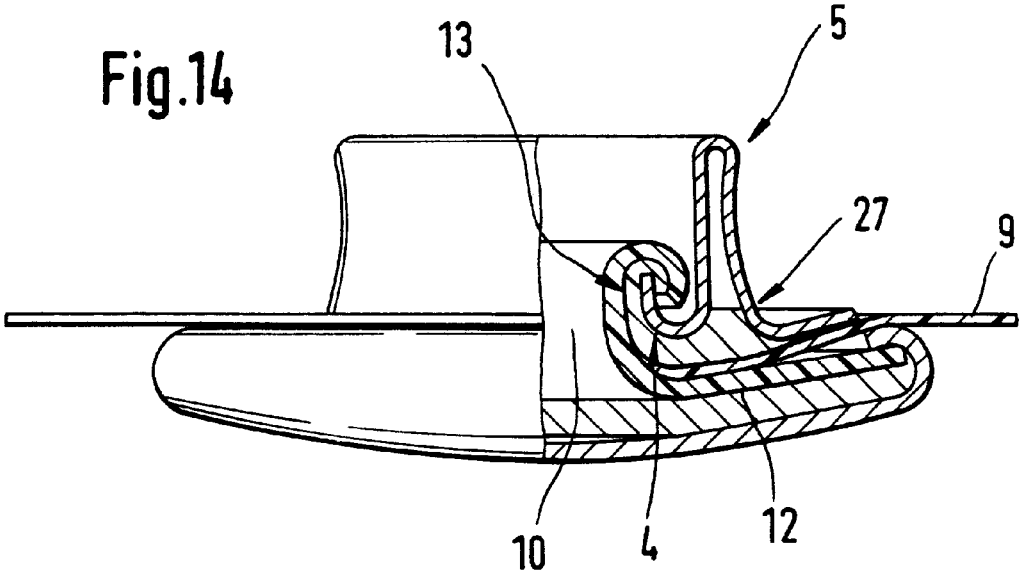
FIG. 14 shows an axial section through the press fastener part formed from the cap rivet according to FIG. 8 and from the unit according to FIG. 13 after being fixed to a climate membrane.

In the construction according to FIGS. 13 and 14, a ball part area 27 which is insertable into the eyelet part 3 and cooperates with the latter follows the holding portion 25 of the ball part 5, which holding portion 25 extends coaxial to the sleeve-shaped portion 15 of the sealing element 12. After the pressing of the ball part 5 with the rivet shank 8, this coaxially undulant ball area 27 holds the annular disk-shaped portion 18 of the sealing element 12 in a position pressed against the underside of the rivet cap accompanied by deformation and with fixed clamping of the flat material 9.

What is claimed is:

1. Watertight press fastener part formed of an eyelet part (1 or 3) comprising an eyelet body (2 or 4) or of a ball part (5) comprising a ball body, each of which has an axial opening (10), and a cap rivet (7) which is fixable to a flat material (9) in a watertight manner by riveting, with an elastically deformable sealing element (11 or 12) which makes contact at the flat material (9) and is constructed as a moulded part, wherein the sealing element (1 or 12), being penetrated by the rivet shank (8) of the cap rivet (7), has in the assembled state due to the deformation of the rivet shank a press face (13) which is formed in an analogous manner by deformation and which surrounds the axial opening (10) of the press fastener part and, together with a counter-face (14) at the eyelet part (1, 3) or at the ball part (5), defines the clamping area for the flat material (9), wherein the sealing element (11, 12) comprises a sleeve-shaped portion (15) followed by a radially outwardly extending annular disk-shaped portion (16), wherein the sleeve-shaped portion (15) of the sealing element (11, 12) is provided in the region of its free edge with (20) a radially outwardly directed reinforcement forming a circumferentially extending undercut (22) and the undercut is provided with a circumferentially extending bevel (21) facilitating assembly, proceeding from the free edge and facing the annular disk-shaped portion (16), and wherein the sealing element (11, 12) is configured for purposes of preassembly to be mounted on the eyelet body (2, 4) forming the eyelet part (1, 3) or on the ball body (6) forming the ball part (5) in such that it penetrates the axial opening (10) of the eyelet body (2, 4) or the axial opening (10) of the ball body (6) with the sleeve-shaped portion and, when subsequently riveted with the rivet shank (8) of the cap rivet (7) guided through the sleeve-shaped portion (15), contacts by its annular disk-shaped portion (16) the flat material (9) interposed between the eyelet part or ball part and cap rivet and is configured to be pressed with this flat material (9).

2. Press fastener part according to claim 1, wherein the sealing element (11) is provided in the sleeve-shaped portion (15) receiving the rivet shank with a circumferentially extending edge (23) formed by a reduction in diameter, wherein a rounded mouth (24) facilitating the insertion of the rivet shank and flat material during pressing leads to this circumferentially extending edge (23).

3. Press fastener part according to claim 1, characterized in that the free end of the sleeve-shaped portion (15) of the sealing element (11, 12) is deformed (FIGS. 6, 11, 14) into a position in which it is bent by almost 180° outward and backward while being carried along by the outer end of the rivet shank (8) during pressing accompanied by fixation of the flat material (9) which is pierced through by the rivet shank (8).

4. Press fastener part according to claim 1, wherein the circumferentially extending bevel (21) proceeding from the free edge of the sleeve-shaped portion (15) of the sealing element (11) and facing the annular disk-shaped portion (16) is constructed so as to be rounded on the outside.

5. Press fastener part according to claim 1, wherein the sleeve-shaped portion (15) of the sealing element (11) is connected with the annular disk-shaped portion (16) by means of a connecting portion (17) which, together with the sleeve-shaped portion, defines a circumferentially extending free (18) groove serving to receive the end of the eyelet shank.

6. Press fastener part according to claim 1, wherein the annular disk-shaped portion (16) directly adjoins the sleeve-shaped portion (15) of the sealing element (12) so as to extend roughly at right angles relative to it, and in that the eyelet part or ball part (3, 5) terminates in a holding portion (25) which engages behind the undercut (22) of the sleeve-shaped portion at the outer side of the sleeve-shaped portion (15).

7. Press fastener part according to claim 1, wherein a radially extending transition area (26) follows the holding portion (25) of the eyelet part, which holding portion (25) extends coaxial to the sleeve-shaped portion (15) of the sealing element (11), wherein, after the pressing of the eyelet part with the rivet shank, the transition area (26) supports the annular disk-shaped portion (16) of the sealing element (12) and holds it in position pressing against the underside of the rivet cap accompanied by fixed clamping of the flat material (9).

8. Press fastener part according to claim 1, wherein a coaxially undulant ball part area (27) which is insertable into the eyelet part (3) and cooperates therewith follows the holding portion (25) of the ball part (5), which holding portion (25) extends coaxial to the sleeve-shaped portion (15) of the sealing element (12), wherein, after the pressing of the ball part (5) with the rivet shank (8), the ball part area (27) holds the annular disk-shaped portion (18) of the sealing element (12) in position pressing against the underside of the rivet cap accompanied by deformation and with fixed clamping of the flat material (9).

9. Press fastener part according to claim 1, wherein the flat material (9) is a climate membrane.

* * * * *